United States Patent [19]

Borgeas

[11] 4,227,320

[45] Oct. 14, 1980

[54] CUSHIONED SOLE FOR FOOTWEAR

[76] Inventor: Alexander T. Borgeas, 129 W. Catalina Dr., Phoenix, Ariz. 85013

[21] Appl. No.: 3,535

[22] Filed: Jan. 15, 1979

[51] Int. Cl.[2] ..... A43B 7/14; A43B 13/20; A43B 13/40; A43B 19/00

[52] U.S. Cl. ..... 36/88; 36/29; 36/44; 36/71; 128/80 D

[58] Field of Search ..... 36/88, 43, 44, 29, 71, 36/11.5; 128/594, 80 D; 2/DIG. 6

[56] References Cited

U.S. PATENT DOCUMENTS

| | | | |
|---|---|---|---|
| 545,705 | 9/1895 | MacDonald | 36/43 X |
| 1,145,534 | 7/1915 | Wetmore | 128/594 |
| 1,241,832 | 10/1917 | Druckenmiller | 128/594 |
| 1,540,430 | 6/1925 | Sims . | |
| 1,979,972 | 11/1934 | Guild | 36/29 |
| 2,100,492 | 11/1937 | Sindler . | |
| 2,633,129 | 3/1953 | Crawford | 128/80 D |
| 2,835,248 | 5/1958 | Scholl | 128/80 D |
| 3,316,663 | 5/1967 | Neu | 36/71 |
| 3,552,044 | 1/1971 | Wiele . | |
| 3,589,037 | 6/1971 | Gallagher . | |
| 4,055,005 | 10/1977 | Meinhart | 2/DIG. 6 |

FOREIGN PATENT DOCUMENTS

| | | | |
|---|---|---|---|
| 79325 | 3/1919 | Switzerland | 36/43 |
| 15786 | of 1900 | United Kingdom | 36/11.5 |

*Primary Examiner*—James Kee Chi

*Attorney, Agent, or Firm*—Warren F. B. Lindsley

[57] ABSTRACT

A sole supporting and cushioning member for footwear controlling the movement of foot/leg muscles in the form of a removable, preferably disposable sole shock absorber that is adapted to afford an elastic or cushioned bearing for the wearer's feet which comprises a pliable coil filled with an elastomeric material to resiliently flex with the movement of the sole of the foot.

11 Claims, 13 Drawing Figures

CUSHIONED SOLE FOR FOOTWEAR

BACKGROUND OF THE INVENTION

This invention relates to footwear and more particularly to sole inserts which deform temporarily when the weight of the human is transferred from the heel to the outside of the foot and then to the ball of the foot and acts as a shock absorber and torque controller to aid in the prevention of ankle, knee, leg and tendon injuries during various physical activities.

Each foot contains, besides the bone structure, 19 muscles plus the tendons of 12 more muscles situated in the leg, more than a hundred ligaments, tough connective and protective layers of fascia and toe nails. It also contains yards of blood vessels and intricate networks of nerves.

A foot in action goes through three forward motions namely heel impact, a transitional horizontal balance phase, and the thrust of the toes, to move the individual into a repetition by the opposite foot of the exhilarating rhythm that comprises walking.

Running and jogging intensifies the shock pressure and/or stress on the feet and particularly the sole since it is the sole that supports the weight of the body during about forty percent of the motion of the leg during walking, running and exercising activities. Thus, a new sole shock absorber is needed to reduce the harmful effects of leg movement which transmits stress and bio-mechanical twisting to the foot, leg and the back muscles.

DESCRIPTION OF THE PRIOR ART

U.S. Pat. No. 545,705 discloses a cushioned sole for footwear which utilizes a pneumatic tubing coiled and secured beneath a foot bearing layer of leather.

U.S. Pat. No. 1,540,430 discloses a ventilated insole for footwear comprising a multiplicity of perforations in the forward half only of the insole.

U.S. Pat. No. 2,100,492 discloses an outer sole for a shoe comprising a plurality of lengths of hollow rubber tubing disposed in longitudinal continuous direct contact with each other.

U.S. Pat. No. 3,552,044 discloses a pad filled with elastomeric pellets or particles which will conform to irregularly shaped feet.

U.S. Pat. No. 3,589,037 discloses a removable foot supporting and cushioning liner for footwear constructed from a pair of laminated gas impervious sheets of thin, lightweight, plastic material having a multiplicity of separate gas filled pockets distributed over the supporting surface of the member.

Applicant has filed a copending U.S. patent application, Ser. No. 944,264, filed Sept. 21, 1978 and entitled HEEL SHOCK ABSORBER FOR FOOTWEAR directed to cushioned heel support.

SUMMARY OF THE INVENTION

This invention is directed to an insert which may be formed of polyester fibers having a coil, elastomerically filled tubular member anchored in and exposed on the sole engaging surface of the insert for use in the sole portion of various types of footwear. The tubular member is developed to resiliently flex under weight transfer to and from the sole of the foot and twisting movement of the sole of the user so as to provide foot and leg muscle comfort and protection particularly during physical activity such as walking, running, jogging or the like.

It is, therefore, one object of this invention to provide a new and improved sole shock absorber and bio-mechanical twisting controlling insert for footwear.

Another object of this invention is to provide new and improved inserts for the soles of various footwear employing a flexible, resilient tubular means embodied in the surface of the inserts for providing foot and leg muscle comfort and protection during physical activities.

A further object of this invention is to provide a new and improved sole insert for footwear embodying elastomeric materials or other fluid substances in a tubular form inlayed in the sole engaging surface of the insert for not only absorbing the force of the weight transferred to and from the sole but also controlling and twisting of the sole portion of the foot which is involved in many ankle, knee, leg and tendon injuries.

A still further object of this invention is to provide a new and improved conveniently removable sole insert which may be selectively positioned in footwear and held therein by a foot or toe surrounding loop or tie or inserted into some suitable base material such as rubber, foam, plastic or cork and placed over the sole of a shoe for providing shock absorption twist controlling movement of the foot and leg muscles and which is sanitary, lightweight and inexpensive when mass produced.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWING

The present invention may be more readily described by reference to the accompanying drawing in which.

DESCRIPTION OF THE PREFERRED EMBODIMENT

In order to control the effects of the weight movement to and from the sole of the foot and bio-mechanical twisting that causes ankle, knee, leg and tendon injuries, a new insert for the soles of various footwear is disclosed. This insert embodies a coil filled with an elastomeric material which provides a resilient, flexible means for absorbing shock and controlling twisting, i.e. torque, which the prior art pneumatic coiled tubes failed to do since they failed to provide enough reaction to the forces applied to the sole during weight transfer to and from it. Consequently injuries continue to plague the human race particularly during running and other physical activities.

Figure 1A:
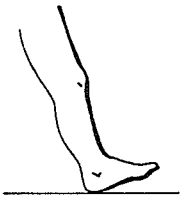
FIGS. 1A–1C illustrate the sequence of foot movement of a human being during walking which includes contact phase, mid-stance phase and propulsive phase.
Figure 1B:
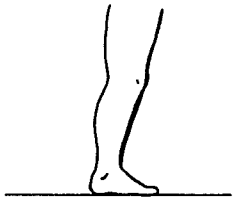
Figure 1C:
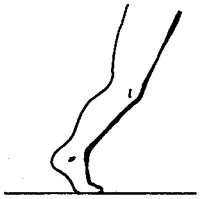

Referring more particularly to the drawings by characters of reference, FIGS. 1A–1C illustrate the various positions of the body, legs and feet of a human when walking which is known in the Podiatric art as the "angle of gait". There are many factors which govern the angle of gait and cause deviations from normal angulation. The angle of gait for any individual is governed by hip joint motion, the amount of femoral and malleolar torsion present, plus or minus the relative adduction or abduction of the whole foot to the body of the talus. FIG. 1A illustrates the contact phase which comprises about twenty-five percent of the stance phase with FIG. 1B illustrating the mid-stance phase representing about forty percent of the stance phase. FIG. 1C illustrates the propulsive phase representing about thirty-five percent of the stance phase.

It should be noted that the internal rotation of the whole limb during its swinging phase and the first phase of the gait, i.e., heelstrike, has a direct bearing upon the transverse positioning of the foot which will be manifested in the transverse motion of the foot and motion within the foot.

When abnormalities affecting the transverse rotation of the whole limb are present, such abnormalities are eventually transferred to the foot. Thus, in order to absorb at least a part of any abnormal force components which affect the relationship of the whole foot as it lines up underneath the trochlea talus, a new and improved sole insert is provided which functions during the mid-stance and propulsive phases, as shown in FIG. 1B, to absorb the bio-mechanical forces and torque applied to the sole of the foot to aid in absorbing these abnormal forces.

Figure 2:
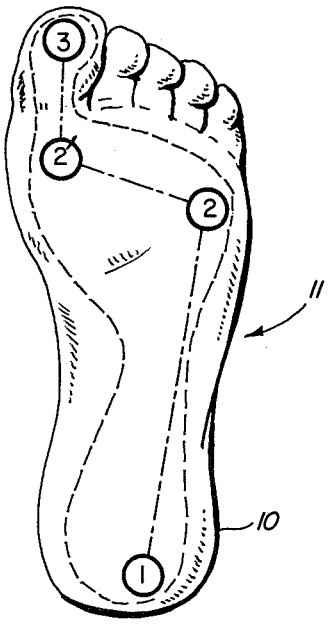
FIG. 2 is a view of the bottom of a foot showing the sequence of spots on the foot which absorb the weight of the body during walking activity.

It should be noted from FIG. 2 and the sequence of pressure points 1–3 that the heel 10 of the human strikes the ground first near point 1 of the foot 11 shown therein during a walking or running effort taking the impact of the body weight. Next the weight is transferred to the outside of the foot near point 2. Thirdly, the weight is shifted from point 2 across the ball of the foot to near the point 2'. Lastly, the weight of the body is shifted to point 3 and then the body propels off from the big toe completing a walking or running step.

Accordingly, to aid in absorbing torque and shearing effect produced by the shifting of body weight along and across the foot whether from a limb abnormality or from a reaction of the foot on the particular surface engaged, the improved sole insert disclosed is provided for footwear use.

Figure 3:
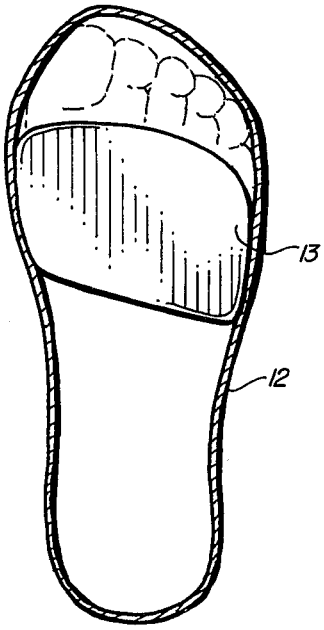
FIG. 3 is a view of the bottom of a foot showing an insert embodying the invention in place underneath the side of the foot.

FIG. 3 of the drawing illustrates a cross-sectional view of the bottom of foot 11 in a shoe 12 and showing a cushioning insert of pad 13 covering the area of the foot 11 defined as 2, 2' in FIG. 2 wherein transverse forces of the bio-mechanical forces and resulting torque occur in the foot during a normal walking or running action of a human.

Figure 4:
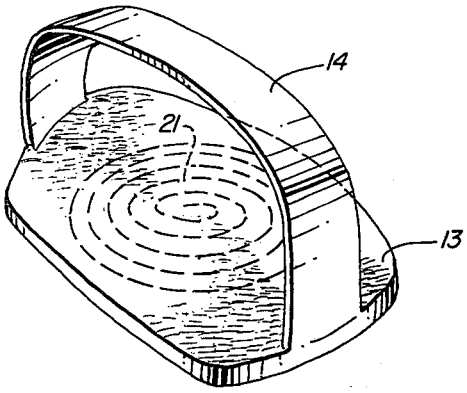
FIG. 4 is a perspective view of a shoe insert for a shoe embodying an arch and forefoot surrounding loop.

FIG. 4 illustrates this pad 13 employing an integral resilient or elastic loop 14 for surrounding the arch and forefoot area of the foot at a point near the toes of the foot. This type of insert may be slipped over the foot of the user prior to insertion of the foot in the footwear or it may be placed previously in the footwear before foot insertion.

Figure 5:
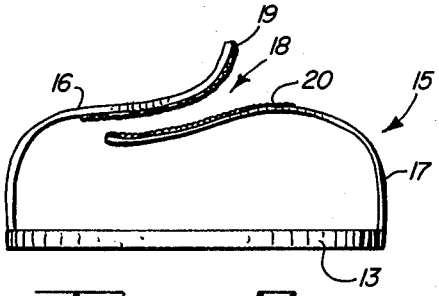
FIG. 5 is an end view of a sole insert for a shoe embodying an arch and forefoot surrounding tie forming a loop.

FIG. 5 illustrates a modification of the pad 13 shown in FIGS. 3 and 4 wherein a loop 15 for the pad 13 may be formed by a pair of ties 16 and 17 which are interconnected by a Velcro fastener 18 comprising two engageable parts 19, 20 secured to each of the free ends of the ties 16 and 17.

Although the cushion or pad 13 of FIGS. 3–5 may be of any suitable resilient material, it is preferable that insert or pad 13 contains within its surface a coiled tubular member 21. This tube may be formed of any suitable material such as rubber, plastic or the like providing strength to retain a tubular form when filled with a suitable elastomeric material such as corn syrup, silicone or any other suitable material which tubular form will be temporarily deformed under impact and twisting action of the sole of the user as more fully described hereinafter.

Figure 6:
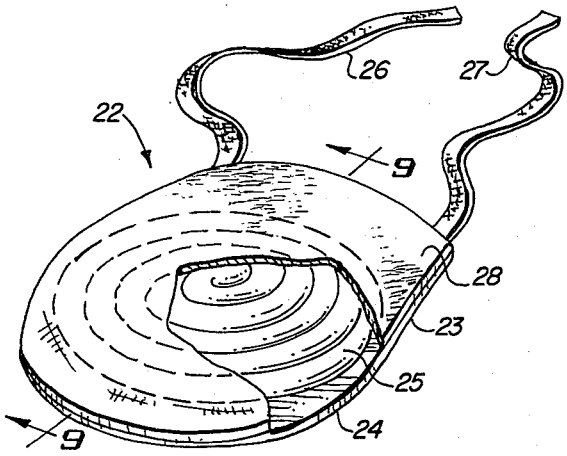
FIG. 6 is a perspective view of a sole insert for footwear and embodying the invention showing a pair of ties for fastening it to a toe or toes of the foot.

As noted from FIG. 6 of the drawings, an insert 22 comprising a cushioned pad formed of a suitable material such as a needled non-woven polyester fiberous product sold by Lydall, Inc. under the trademark UNI-SOCK is provided. This insert comprises a relatively flat platform or pad portion 23 of a suitable thickness such as, for example, one-eighth or one-quarter of an inch which has positioned on, in it or at least partially embedded in its relatively flat top surface 24 a coiled tubular member 25. It should be recognized that the tubular member 25 may be inserted in an aperture or punched out hole in the pad portion or held together by top and bottom cover members. A pair of flat or circular ties 26, 27 are spacedly attached along the periphery of the pad portion 23 for positioning at the sole portion of the footwear with the ties 26, 27 being tied around a toe such as the second toe for holding the insert in a given selected sole position. It should be noted that the pad portion 23 may be covered with a transparent or opaque cover 28.

Figure 7:
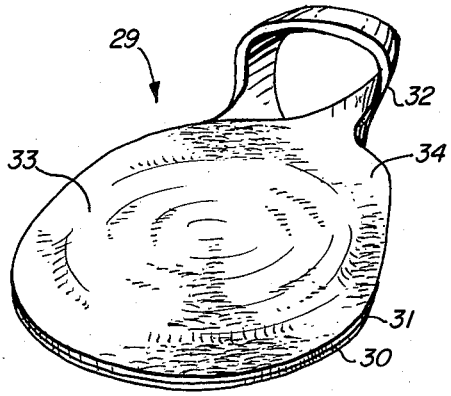
FIG. 7 is a perspective view of a modification of the sole insert shown in FIG. 3 wherein the tie member forms a loop.

FIG. 7 illustrates a modification of the single layer or laminated sole insert shown in FIG. 6 wherein an insert 29 comprises two superimposed pad portions 30 and 31 which are interconnected by a flat elongated tie which forms a loop 32 when the pad portions 30 and 31 are superimposed one on the other as shown in FIG. 7 for positioning in the sole below the sole portion of the foot with the loop 32 of the insert fitted around a toe or toes of the foot under which the insert is positioned.

As shown in FIG. 7, the pad portions 30 and 31 may be formed of a suitable material such as the needled non-woven polyester fiberous product described above for pad 22 with pad portion 30 containing a coiled tubular member 33 at least partially or fully embedded in its relatively flat top surface 34 or resting on top thereof. The tubular member 33 is the same structure described above for the coil tubular member 25.

Both coil tubular members 25 and 33 may be formed of any suitable material, such as the rubber, plastic or the like material described above since this type of material provides the strength to retain a tubular form when filled with a suitable elastomeric material such as corn syrup, silicone material or fluid such as water and may be temporarily deformed under impact and twisting action of the sole of the user.

Elastomeric pellets comprising Shell Chemical Corporation's "Thermolastic" comprising a butadiene-styrene copolymer having a durometer reading of about 45 Shore A also may be used as a filler in the tubular members 21, 25 and 33. It should be noted that all elastomeric material used assumes its original condition quickly after sole pressure is removed therefrom. These pellets may be coated with a silicone grease if so desired such as Dow Corning No. 7 lubricant.

Figure 8:
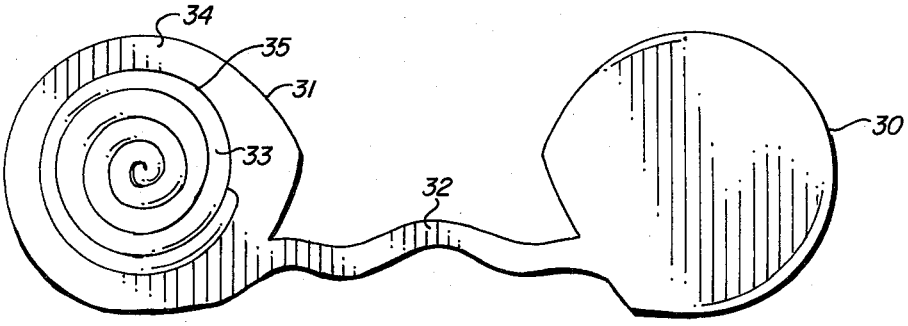
FIG. 8 is a view of FIG. 7 showing the component parts of the sole insert shown in FIG. 7 in spread apart planar position.
Figure 9:
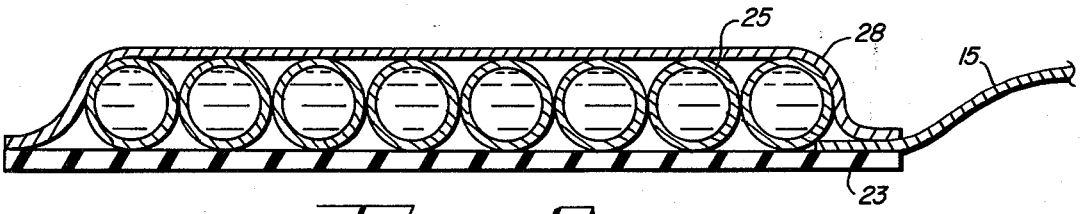
FIG. 9 is a cross-sectional view of FIG. 6 taken along the line 6—6.

As further shown in FIG. 8, the tubular member 33 may snugly fit into the circular or other configuration type of opening 35 in portion 31 of insert 29. It may be flush with or arranged to protrude slightly therefrom or placed on a flat surface covered by a laminated material so that the pressure of the wearer of the footwear would essentially feel the total surface 34 of the insert with its center portion providing a more deformable portion than the remainder of the top surface of the insert.

Figure 10:
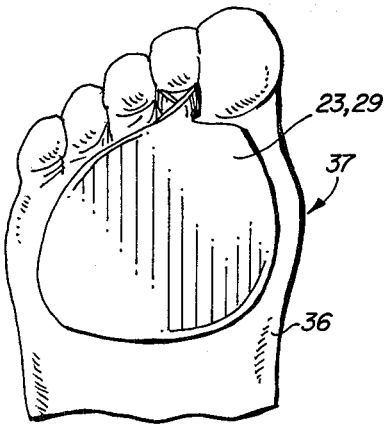
FIG. 10 is a bottom view of a foot showing the sole insert of FIG. 6 or 7 in position on the foot.

FIG. 10 illustrates the bottom 36 of a foot 37 illustrating the position of pad portion 23 of FIG. 6 or insert 29 of FIG. 7 When positioned in footwear at the chosen position for absorbing the forces and torques described above.

Figure 11:
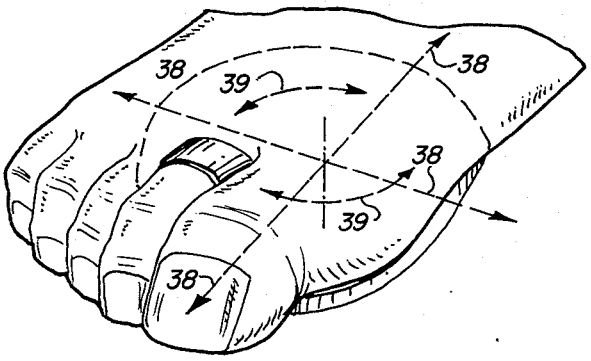
FIG. 11 is a perspective view of the insert shown in FIGS. 4–7 illustrating the forces conveyed to the sole of the foot including the bio-mechanical twisting forces of the foot absorbed by the tubular, elastomeric or fluid filled inlayed coil.

FIG. 11 illustrates in more detail the forces absorbed by pad 23 or insert 29 and particularly the tubular members 21, 25 and 33 thereof when foot 11, 36 applies pressure thereto during walking, running and jogging activities. As shown, when a user's foot and particularly its sole reacts to the forces applied thereto, the tubular members of these pads or inserts receives the force of its movement which are transmitted through the tubular members and the side walls of the openings in the pad portions or the retaining materials housing the tubular members radially to the periphery of the insert as shown by the arrows 38. This force is absorbed by the footwear within which the pads or inserts are positioned.

Any torque applied by the sole to the tubular member is also absorbed and substantially dissipated by the coiled configuration of the tubular member. Such torque is illustrated by the arcuate arrows 39.

It should also be noted that the insert may be positioned in a shoe rotated 180 degrees, or turned upside down, if so desired.

Thus, an insert is provided for the ball of the foot which fits either the right or left foot and is worn within the footwear with or without an arch, loop or foot engaging tie or loop slipped over or tied around the arch, forefoot or toe or toes of either foot. The loop or releasable tie should be smooth and flat around the arch, forefoot or toes and position the insert across the sole of the foot.

Although but a few embodiments of the invention have been illustrated and described, it will be apparent to those skilled in the art that various changes and modifications may be made therein without departing from the spirit of the invention or from the scope of the appended claims.

What is claimed is:

1. An insert for covering at least a part of the sole position of footwear comprising:

a pad portion, said pad portion comprising a relatively flat sole engageable member having a circular aperture therein, a resilient tubular member secured within said aperture in said flat sole engageable member in a coiled configuration substantially flush with the flat engaging surface of said sole engaging member, said tubular member comprises a hollow configuration filled with a fluid material and means for anchoring the pad to the sole portion of the footwear used, whereby when the sole of a user is applied to said tubular member, it momentarily distorts under its pressure and returns to its initial position when the force is changed thereby serving as a shock and torque absorber for the footwear.

2. The insert set forth in claim 1 wherein:

said means comprises loop means for surrounding the arch of a foot.

3. The insert set forth in claim 2 wherein:

said loop means comprises a resilient material.

4. The insert set forth in claim 2 wherein:

said loop means comprises an elastic material.

5. The insert set forth in claim 2 wherein:

said loop means comprises a pair of ties interconnected by a Velcro fastener.

6. The insert set forth in claim 1 wherein:

said means comprises a toe surrounding means fastened to said pad portion for anchoring the pad to the foot when within the footwear used.

7. The insert set forth in claim 6 wherein:

said toe surrounding means comprises a pair of tie strings.

8. The insert set forth in claim 6 wherein:

said toe surrounding means comprises a loop means for surrounding at least one toe of the foot under which said pad portion is positioned.

9. The insert set forth in claim 1 wherein:

said tubular member comprises a hollow configuration filled with an elastomeric material.

10. The insert set forth in claim 1 wherein:

said pad portion is formed of a fibrous material.

11. The insert set forth in claim 6 and further comprising:

a second pad portion interconnected by said toe surrounding means to said pad portion, said second pad portion being substantially of the same geometrical configuration as said pad portion and aligned and juxtapositioned therewith when forming the insert.

* * * * *